US008665203B2

(12) United States Patent
Abe

(10) Patent No.: US 8,665,203 B2
(45) Date of Patent: Mar. 4, 2014

(54) ELECTRONIC DEVICE HAVING DISPLAY AND METHOD FOR CONTROLLING DISPLAY BRIGHTNESS

(75) Inventor: Sachiko Abe, Tokyo (JP)

(73) Assignee: Fujitsu Mobile Communications Limited, Kawasaki (JP)

( * ) Notice: Subject to any disclaimer, the term of this patent is extended or adjusted under 35 U.S.C. 154(b) by 889 days.

(21) Appl. No.: 12/541,268

(22) Filed: Aug. 14, 2009

(65) Prior Publication Data

US 2010/0177111 A1 Jul. 15, 2010

(30) Foreign Application Priority Data

Jan. 14, 2009 (JP) ..... 2009-6108

(51) Int. Cl.
*G09G 3/36* (2006.01)

(52) U.S. Cl.
USPC ..... 345/102; 345/204

(58) Field of Classification Search
USPC ..... 345/102, 204
See application file for complete search history.

(56) References Cited

U.S. PATENT DOCUMENTS

2002/0075249 A1* 6/2002 Kubota et al. ..... 345/204
2002/0118182 A1* 8/2002 Weindorf ..... 345/204
2007/0146354 A1* 6/2007 Kubota et al. ..... 345/204
2007/0211046 A1* 9/2007 Taylor et al. ..... 345/207
2008/0158211 A1* 7/2008 Kwon ..... 345/207
2009/0128529 A1* 5/2009 Izumi et al. ..... 345/207
2009/0160834 A1* 6/2009 Tseng et al. ..... 345/207

FOREIGN PATENT DOCUMENTS

JP 2004-070195 A 3/2004
JP 2005-236524 A 9/2005
JP 2006-267440 A 10/2006
JP 2007-020232 A 1/2007
JP 2007020232 A * 1/2007

OTHER PUBLICATIONS

JP Office Action mailed on Jul. 10, 2012 as received in application No. 2009-006108.

* cited by examiner

*Primary Examiner* — Viet Pham
(74) *Attorney, Agent, or Firm* — Maschoff Brennan

(57) ABSTRACT

An electronic device having a display unit, an indicator, an illuminance sensor and a controller is provided. The indicator is configured to be turned on for emitting light and to be turned off. The illuminance sensor is configured to sense ambient illuminance. The controller is connected to the display unit, the indicator and the illuminance sensor. The controller is configured to turn on and off the indicator. The controller is configured to set brightness of the display unit depending on a value of the ambient illuminance sensed by the illuminance sensor while the indicator continues to be off.

14 Claims, 6 Drawing Sheets

ELECTRONIC DEVICE HAVING DISPLAY AND METHOD FOR CONTROLLING DISPLAY BRIGHTNESS

CROSS-REFERENCE TO RELATED APPLICATIONS

This application is based upon and claims the benefit of priority from the prior Japanese Patent Application No. 2009-006108 filed on Jan. 14, 2009; the entire contents of which are incorporated herein by reference.

BACKGROUND OF THE INVENTION (i) Field of the Invention

The present invention relates to an electronic device having a display and an illuminance sensor for controlling display brightness on the basis of ambient illuminance, and to a method for controlling the display brightness. The electronic device is configured to control measurement of illuminance by means of the illuminance sensor on the basis of an on-or-off state of an LED provided to the electronic device.

(ii) Description of the Related Art

A recent trend of some electronic device such as a mobile phone or a mobile data terminal is that it consumes more power as it is equipped with a display of a greater size or a processor of a higher operating frequency. Thus, a lot of electronic devices are configured to measure ambient brightness by using their illuminance sensors, and to control use of their displays with minimally required backlight brightness these days.

A mobile communication device configured to consume less power is disclosed, e.g., in Japanese Patent Publication of Unexamined Application (Kokai) No. 2005-236524. The mobile communication device of JP 2005-236524 is configured to minimize an effect of turning on and off of a light for illuminating the surroundings, and to optimize brightness levels of an operation unit and a display unit so as to consume less power. The mobile communication device of JP 2005-236524 is configured to control, as usual, a brightness level of a backlight for the operation unit in accordance with an ambient illuminance level sensed by a photosensor. If the light is turned on, though, the mobile communication device turns on the backlight for the operation unit regardless of a sensing level of the photosensor while taking an effect of the light to the sensing level of the photosensor into account.

It is generally known that an electronic device such as a mobile phone has an LED for indicating that its battery is being recharged, or that a missed call or an unread email exists. If, however, the LED and the illuminance sensor are arranged close to each other, such an arrangement may cause a problem that the illuminance sensor senses light of the LED resulting in that the backlight brightness cannot be properly controlled.

The present invention has been made in view of the above circumstances and provides electronic equipment in which the brightness of a back light is properly controlled on the basis of illuminance even when LED and an illuminance sensor are provided in proximity to each other.

SUMMARY OF THE INVENTION

Accordingly, an advantage of the present invention is that display brightness of an electronic device can be properly controlled even if the electronic device is provided with an indicator such as an LED and an illuminance sensor arranged close to each other.

To achieve the above advantage, one aspect of the present invention is to provide an electronic device having a display unit, an indicator, an illuminance sensor and a controller. The indicator is configured to be turned on for emitting light and to be turned off. The illuminance sensor is configured to sense ambient illuminance. The controller is connected to the display unit, the indicator and the illuminance sensor. The controller is configured to turn on and off the indicator. The controller is configured to set brightness of the display unit depending on a value of the ambient illuminance sensed by the illuminance sensor while the indicator continues to be off.

BRIEF DESCRIPTION OF THE DRAWINGS

Embodiments of the present invention will be described in detail with reference to following drawings, wherein.

DETAILED DESCRIPTION OF THE INVENTION

First Embodiment

A first embodiment of the present invention will be described with reference to FIGS. 1A-7. A mobile phone 1, which includes two housing sections connected to each other in such a way as to slide against each other and configured to be open and closed to each other, will exemplify an electronic device of the first embodiment.

Figure 1A:
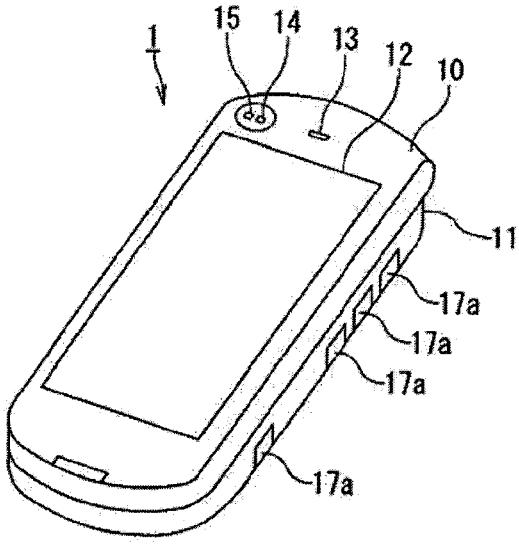
FIGS. 1A and 1B are perspective views showing an electronic device (mobile phone) of a first embodiment of the present invention being closed and being open, respectively.
Figure 1B:
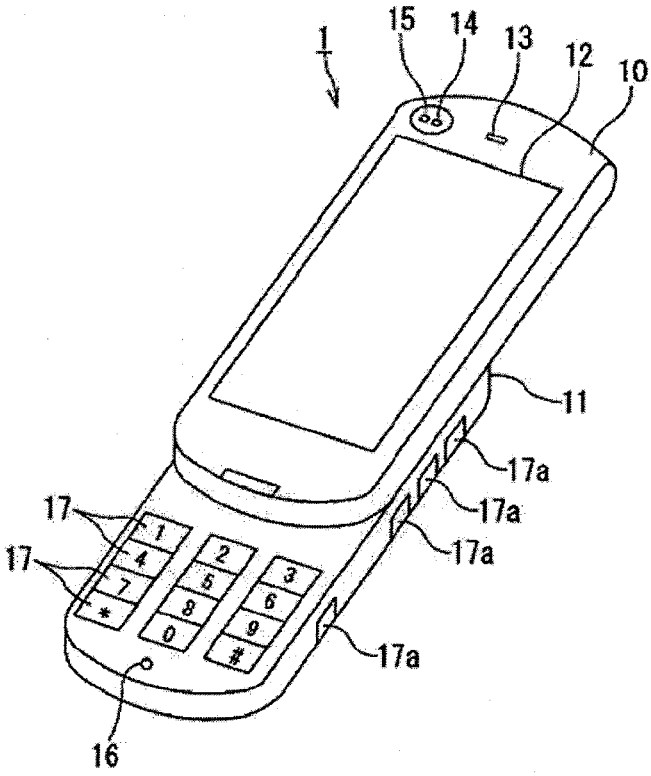

FIGS. 1A and 1B are perspective views showing the mobile phone 1 being closed and being open, respectively. As shown in FIGS. 1A and 1B, the mobile phone 1 is constituted by a rectangular planar-shaped upper housing 10 and a lower housing 11 of substantially the same shape as the upper housing 10. While being closed to each other, the upper and lower housings 10 and 11 are stacked so that the upper housing 10 covers a face of the lower housing 11 and vice versa. The upper housing 10 and the lower housing 11 are connected to each other in such a way as to slide against each other in a particular direction (e.g., in a longer side direction of the housings 10 and 11) by a certain length. The upper housing 10 is configured to slide against the lower housing 11 so that the mobile phone 1 can change its state from closed to open, and vice versa.

An outer face of the upper housing 10 (on the side not facing the lower housing 11) is provided with a touch screen 12 and a speaker 13. The touch screen 12 is configured to display a screen formed by text, images and so on, and to accept an entered direction by sensing contact with a finger, a stylus and so on. The speaker 13 is configured to produce voice and sound. The touch screen 12 is a display unit having both a display function and an input operation function. The display function is for displaying a screen formed by text, images and so on. The input operation function is for accepting data represented by a position where a finger or a dedicated stylus is in contact with the touch screen 12.

The touch screen 12 is formed, e.g., by a plurality of elements arranged on an upper surface of the display for sensing contact on the surface, and a transparent screen layered on top of the elements. The touch screen 12 may sense contact by using a pressure sensing method for sensing a pressure change, an electrostatic method for sensing an electrical signal caused by static electricity, or other methods.

The outer face of the upper housing 10 is provided with an LED (light emitting diode) 14 and an illuminance sensor 15. The LED 14 is turned on so as to indicate that a battery is being recharged, that a missed call or an unread email exists and so on. The illuminance sensor 15 is configured to sense ambient illuminance. The illuminance sensor 15 may include, e.g., a phototransistor, a photodiode, a photodiode plus an amplifier circuit, or the like.

The touch screen 12, the speaker 13, the LED 14 and the illuminance sensor 15 are provided in such a way as to be exposed to the outside regardless of whether the mobile phone 1 is closed or open. Accordingly, the mobile phone 1 can allow a user to view a screen and to enter a direction on the touch screen 12, and the illuminance sensor 15 can sense ambient illuminance, regardless of whether the mobile phone 1 is closed or open.

An inner face of the lower housing 11 (on the side facing the upper housing 10) is provided with a microphone 16 for collecting voice and sound, and a plurality of operation keys 17 which a user can press so as to provide the mobile phone 1 with a direction. If the mobile phone 1 is closed, the operation keys 17 are covered by the upper housing 10 and thus are not exposed to the outside. If the upper housing 10 slides against the lower housing 11 and thus the mobile phone 1 opens, the operation keys 17 are exposed to the outside. Accordingly, if the mobile phone 1 is open, a user can provide the mobile phone 1 with a direction through the operation keys 17. If the mobile phone 1 is closed, the user cannot provide the mobile phone 1 with a direction through the operation keys 17.

A side face of the lower housing 11 is provided with a plurality of operation keys 17*a* which a user can press so as to provide the mobile phone 1 with a direction. The operation keys 17*a* are provided in such a way as to be exposed to the outside regardless of whether the mobile phone 1 is closed or open. Accordingly, the mobile phone 1 can allow a user to enter a direction through the operation keys 17*a* regardless of whether the mobile phone 1 is closed or open.

Figure 2:
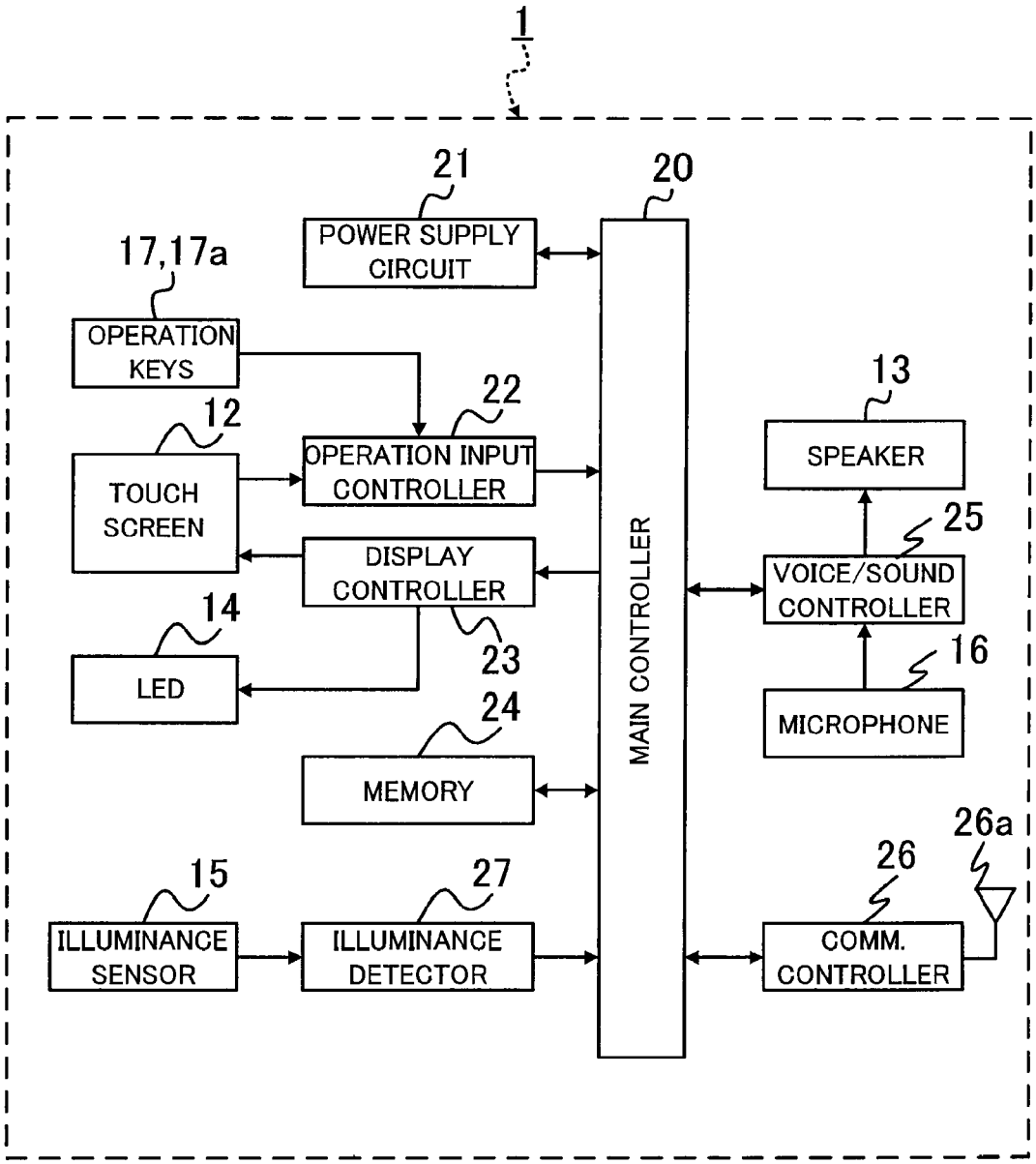
FIG. 2 is a functional block diagram of the electronic device (mobile phone) of the first embodiment.

Then, functions of the mobile phone 1 will be described with reference to a block diagram shown in FIG. 2. As shown in FIG. 2, the mobile phone 1 has a main controller 20, a power supply circuit 21, an operation input controller 22, a display controller 23, a memory 24, a voice/sound controller 25, a communication controller 26 and an illuminance detector 27 which are connected to one another through a bus so as to communicate with one another.

The main controller 20 includes a CPU (central processing unit) and comprehensively controls the mobile phone 1, and also performs an illuminance sensor control process described later and other various arithmetic and control processes. The power supply circuit 21 has a power supply source such as a battery or the like. The power supply circuit 21 turns the power supply on and off depending on a user's input operation through the operation keys 17. If the power supply is turned on, the power supply circuit 21 supplies each of portions of the mobile phone 1 with power from the power supply source so as to activate the mobile phone 1.

The operation input controller 22 has an input interface for the touch screen 12 and the operation keys 17 and 17*a*. Upon sensing an operation such as contact on the touch screen 12 or a press of one of the operation keys 17 and 17*a*, the operation input controller 22 generates a signal indicating the operation and transmits the signal to the main controller 20.

The display controller 23 has a display interface for the touch screen 12 and the LED 14. The display controller 23 is controlled by the main controller 20 so as to display a screen formed by text, an image and so forth on the touch screen 12, and to turn on or off the LED 14. The display controller 23 is controlled by the main controller 20 so as to adjust brightness of the touch screen 12 (or brightness of a backlight provided to the touch screen 12). Moreover, the display controller 23 is controlled by the main controller 20 so as to generate a signal indicating whether the LED 14 is lit (on) or not (off), and to transmit the signal to the main controller 20.

The memory 24 includes a ROM (read only memory) or a hard disk for storing a program of a process to be performed by the main controller 20, data required for the process and so on, a non-volatile memory, a database, a RAM (random access memory) for temporarily storing data which the main controller 20 uses while performing the process. Moreover, it is assumed that a program for the illuminance sensor control process described later is stored, e.g., in the ROM. Moreover, the memory 24 stores a reference value of the brightness of the touch screen 12 (or of the backlight).

The voice/sound controller 25 is controlled by the main controller 20 so as to generate an analog voice signal from voice collected by the microphone, and to convert the analog voice signal into a digital voice signal. Moreover, upon obtaining a digital voice signal, the voice/sound controller 25 is controlled by the main controller 20 so as to convert the digital voice signal into an analog voice signal, and produces voice from the speaker 13.

The communication controller 26 is controlled by the main controller 20 so as to de-spread a spread spectrum signal received from a base station (not shown) through an antenna 26*a*, and to restore data carried by the received signal. The communication controller 26 can be controlled by the main controller 20 so as to provide the data to the voice/sound controller 25 so that voice based on the data is produced through the speaker 13, to the display controller 23 so that the data is displayed on the touch screen 12, or to the memory 24 so that the data is stored in the memory 24.

Moreover, upon obtaining voice data collected by the microphone 16, data entered through the touch screen 12 or the operation keys 17 or 17*a* or the like, or data stored in the memory 24 under the control of the main controller 20, the communication controller 26 performs a spectrum spreading process and transmits the processed data to the base station through the antenna 26*a*.

The illuminance detector 27 has an interface for the illuminance sensor 15. Upon obtaining illuminance data sensed by the illuminance sensor 15, the illuminance detector 27 generates a signal representing the illuminance data and transmits the signal to the main controller 20.

The mobile phone 1 has a function for adjusting brightness of the touch screen 12 to a proper value in accordance with ambient illuminance sensed by the illuminance sensor 15. In some cases, however, where the LED 14 and the illuminance sensor 15 are arranged close to each other, there is a possibility that the mobile phone 1 cannot properly control the brightness of the touch screen 12, as the illuminance sensor 15 senses light of the LED 14. Therefore, the mobile phone 1 has an illuminance sensor control function for controlling the illuminance sensor 15 in such a way that the illuminance sensor 15 measures illuminance only after the LED 14 is turned off. Accordingly, the mobile phone 1 can measure the ambient illuminance by using the illuminance sensor 15 so as to control the touch screen 12 in such a way as to keep the brightness to a requisite minimum.

Figure 3:
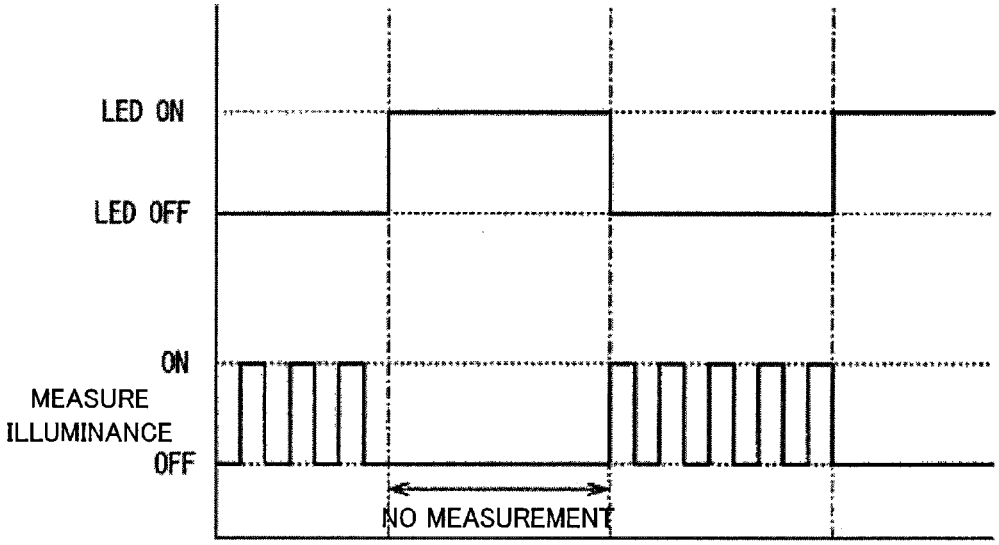
FIG. 3 shows a relationship between a change of an on-or-off state of an LED and a change of an on-or-off state of an illuminance sensor of the electronic device (mobile phone) of the first embodiment.

FIG. 3 shows a relationship between a change of an on-or-off state of the LED 14 while it is blinking and a change of an on-or-off state of the illuminance sensor 15. As shown in FIG. 3, the mobile phone 1 is configured to periodically measure the ambient illuminance affected by the on-or-off state of the LED 14, to calculate a proper brightness value of the touch screen 12 on the basis of the measured value of the illuminance at that time, and to update the brightness of the touch screen 12.

It is assumed that the mobile phone 1 checks the on-or-off state of the LED 14, and that it measures the illuminance by using the illuminance sensor 15 while the LED 14 is being off. That is, the mobile phone 1 does not measure the illuminance while the LED 14 is being on (the LED 14 is being lit), and measures the illuminance only while the LED 14 is being off (the LED 14 is not being lit). The mobile phone 1 can thereby prevent the illuminance sensor 15 from sensing light of the LED 14.

As described above, the mobile phone 1 performs the illuminance sensor control process for controlling the illuminance measurement by means of the illuminance sensor 15 on the basis of the on-or-off state of the LED 14. A procedure for the illuminance sensor control process performed by the mobile phone 1 will be described with reference to flowcharts shown in FIGS. 4 and 6. It is assumed that the LED 14 has been turned on and is lit at the beginning. Hereafter, a term such as "step S101" is shortened as "S101" by omitting the term "step".

First, the main controller 20 judges whether the LED 14 continues to be on for a long time (S101). At this time, if the LED 14 continues to be on for a time length equal to or longer than a given time length (e.g., one second), the main controller 20 judges that the LED 14 continues to be on for a long time. In a case where the battery of the mobile phone 1 is being recharged, e.g., the main controller 20 judges that the LED 14 continues to be on for a long time. In a case where the LED 14 is blinking, e.g., to indicate existence of a missed call, the main controller 20 judges that the LED 14 does not continue to be on for a long time.

Upon judging that the LED 14 does not continue to be on for a long time, i.e., the LED 14 is blinking ("NO" of S101), the main controller 20 judges whether the LED 14 was turned off after being on (S103). At this time, the main controller 20 receives a signal indicating the on-or-off state of the LED 14 from the display controller 23, and judges on the basis of the above signal whether the LED 14 was turned off after being on. If the LED 14 was not turned off ("NO" of S103), the process returns to S101, and the main controller 20 judges whether the LED 14 continues to be on for a long time.

If the LED 14 was turned off after being on ("YES" of S103), the main controller 20 measures the ambient illuminance by using the illuminance sensor 15 in order to adjust the brightness of the touch screen 12 on a real-time basis in accordance with the ambient illuminance (S105). Moreover, the main controller 20 adjusts the brightness of the touch screen 12 in accordance with the illuminance measured at S105 (S107).

The main controller 20 judges whether the LED 14 was turned on again after judging that the LED 14 was turned off at S103 (S109). At this time, the main controller 20 receives a signal indicating the on-or-off state of the LED 14 from the display controller 23, and judges whether the LED 14 was turned on after being off depending on the above signal.

If the LED 14 was not turned on ("NO" of S109), the process returns to S105, and the main controller 20 performs the process from S105 to S109. If the LED 14 was turned on ("YES" of S109), the process returns to S101, and the main controller 20 waits for the LED 14 to be turned off again.

Figure 5:
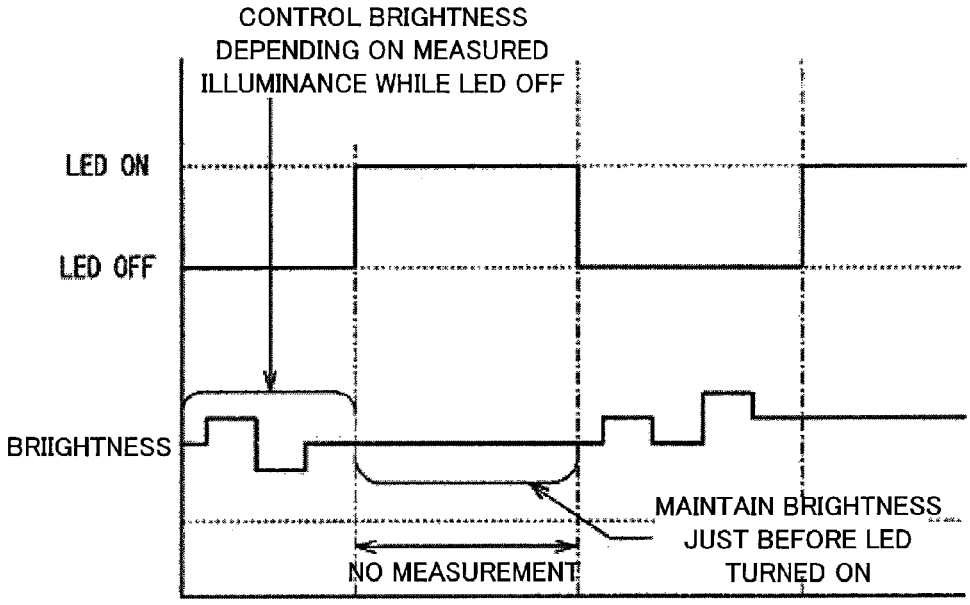
FIG. 5 shows a relationship between the on-or-off state of the LED and the brightness of a touch screen of the first embodiment in a case where the LED blinks.
Figure 4:
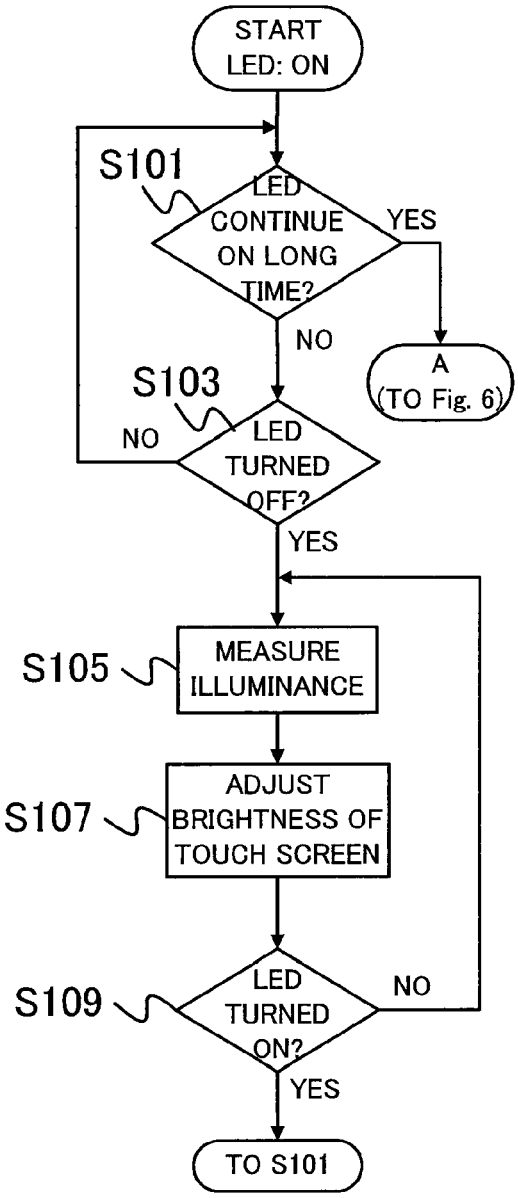
FIG. 4 is a flowchart showing the procedure of an illuminance sensor control process of the first embodiment in a case where the LED blinks.

FIG. 5 shows a relationship between the on-or-off state of the LED 14 and the brightness of the touch screen 12 while the LED 14 is blinking. In such a case, as the LED 14 continues to be on for a short time, a period of time for which the illuminance is not measured is short as well, and thus it is unnecessary to control the brightness of the touch screen 12 in accordance with an illuminance change while the illuminance is not being measured. Moreover, if the main controller 20 controls the brightness of the touch screen 12 in accordance with the illuminance change for such a short period of time, a screen displayed on the touch screen 12 may possibly flicker and usability may be degraded.

Therefore, upon judging that the LED 14 does not continue to be on for a given time length, the main controller 20 controls the brightness of the touch screen 12 in accordance with the ambient illuminance, as shown in FIG. 5. If the LED 14 is turned on, the main controller 20 maintains the brightness value of the touch screen 12 that was set before the LED 14 is turned on in accordance with the measured illuminance value.

Figure 6:
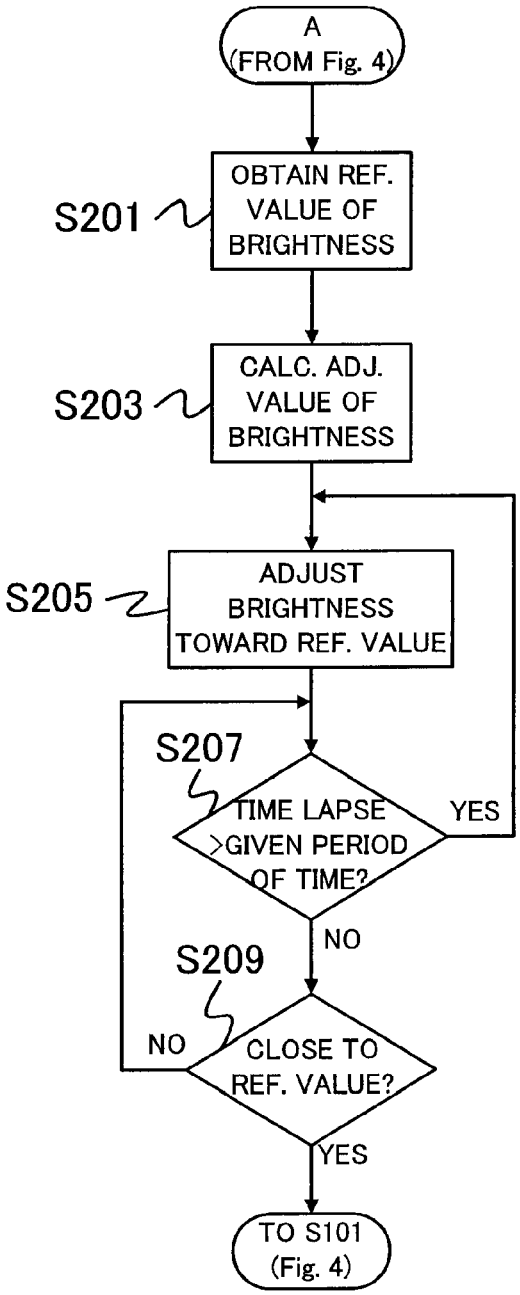
FIG. 6 is a flowchart showing the procedure of the illuminance sensor control process of the first embodiment in a case where the LED continues to be on for a long time.

Meanwhile, upon judging that the LED 14 continues to be on for a long time ("YES" of S101), the main controller 20 obtains a reference value β of the brightness of the touch screen 12 from the memory 24 (S201 shown in FIG. 6). The main controller 20 calculates an adjustment value θ of the brightness of the touch screen 12 depending on the reference value obtained at S201 (S203).

Figure 7:
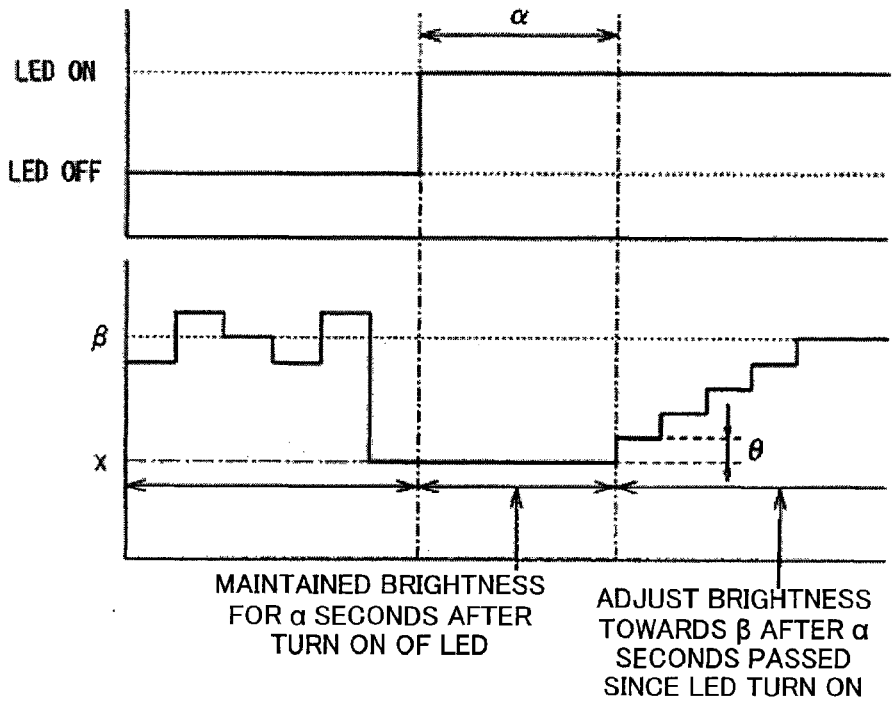
FIG. 7 shows a relationship between the on-or-off state of the LED and the brightness of the touch screen of the first embodiment in a case where the LED continues to be on for a long time.

FIG. 7 shows a relationship between the on-or-off state of the LED 14 and the brightness of the touch screen 12 in a case where the LED 14 continues to be on for a long time. If the main controller 20 controls the brightness similarly as in the case where the LED 14 is blinking in such an occasion, and if the brightness of the touch screen 12 finally set while the LED 14 is being off is improper (e.g., too bright or too dark), there will be a problem that the improper brightness is fixed while the LED 14 continues to be on.

In order to address the above problem, as shown in FIG. 7, upon judging that the LED 14 continues to be on for a given time length, the main controller 20 controls the brightness of the touch screen 12 so that it comes close to the reference value β step by step by θ (the adjustment value calculated at S203). The above brightness control of the touch screen 12 performed step by step by θ is for preventing the touch screen 12 from changing the brightness a lot and causing a screen displayed on the touch screen 12 to flicker.

The adjustment value θ of the brightness of the touch screen 12 equals a difference between the brightness value finally set while the LED 14 was being off and the reference value β divided by n (a natural number). Let the brightness value finally set while the LED 14 was being off be x. Then, the adjustment value θ is represented by Equation (1).

$$\theta=|x-\beta|/n \quad (1)$$

After a given time length since the LED 14 was turned on (as indicated by "a" in FIG. 7), the brightness of the touch screen 12 is updated depending on following Equations (2) and (3). If a difference between a currently set brightness value x(now) of the touch screen 12 and the reference value β is greater than θ, an updated brightness value x(new) of the touch screen 12 is made closer to β by θ than x(now) is. The above process will be repeated until the brightness of the touch screen 12 reaches β. If the difference is equal to or less than θ, let x(new) be the reference value β, and the brightness of the touch screen 12 is fixed to β while the LED 14 is being on.

If the difference between the reference value β and the currently set brightness value x(now) of the touch screen 12 is greater than θ, $$X(\text{new})=x(\text{now})\pm\theta \quad (2)$$

If the difference between the reference value β and the currently set brightness value x(now) of the touch screen 12 is equal to or less than θ, $$X(\text{new})=\beta \quad (3)$$

The main controller 20 adjusts the brightness of the touch screen 12 depending on the adjustment value calculated at S203 (S205). Then, the main controller 20 compares a lapse of time after adjusting the brightness of the touch screen 12 at S205 with a given period of time (e.g., one second) (S207). If the above lapse of time is longer than the given period of time ("YES" at S207), the process returns to S205, and the main controller 20 adjusts the brightness of the touch screen 12.

If the above lapse of time is not longer than the given period of time ("NO" of S207), the main controller 20 judges whether the brightness of the touch screen 12 comes close to the reference value obtained at S201 (S209). At this time, if a difference between an actual brightness value of the touch screen 12 and the reference value is equal to or less than the adjustment value calculated at S203, e.g., the main controller 20 judges that the brightness of the touch screen 12 comes close to the reference value.

Unless the brightness of the touch screen 12 comes close to the reference value ("NO" of S209), the process returns to S207, and the main controller 20 compares a lapse of time after adjusting the brightness of the touch screen 12 at S205 with a given period of time. If the brightness value of the touch screen 12 comes close to the reference value ("YES" of S209), the process returns to S101, and the main controller 20 waits for the LED 14 to be turned off. It is noted that the process always branches to "NO" at S101 before the LED 14 is turned off ("YES" of S103).

As described above, the mobile phone 1 measures the illuminance only while the LED 14 is being off. Moreover, if the LED 14 blinks after being turned on, the mobile phone 1 adjusts the brightness of the touch screen 12 on the basis of the ambient illuminance. If the LED 14 continues to be on for a long time, the mobile phone 1 adjusts the brightness of the touch screen 12 step by step on the basis of the preset reference value. Accordingly, the mobile phone 1 can set optimum brightness on the touch screen 12 in any circumstances.

According to the first embodiment, the mobile phone 1 can adjust the brightness of the touch screen 12 on the basis of the on-or-off state of the LED 14 so as to prevent the illuminance sensor 15 from sensing light of the LED 14, even if the LED 14 and the illuminance sensor 15 are arranged close to each other. The mobile phone 1 can thereby properly control the brightness of the touch screen 12 on the basis of the ambient illuminance.

Second Embodiment

Figure 9:
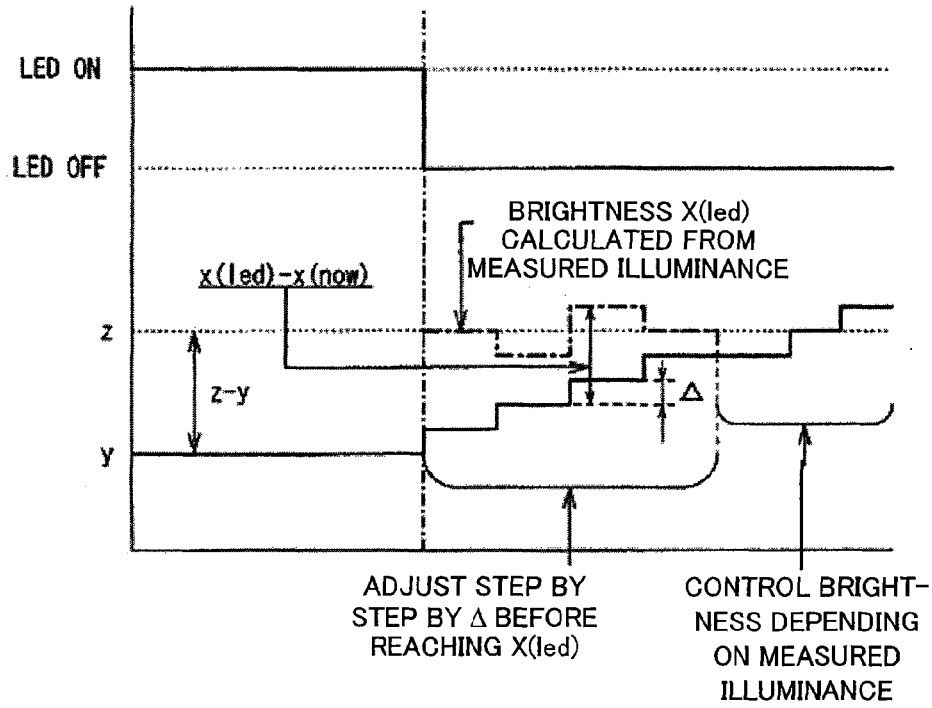
FIG. 9 shows a relationship between the on-or-off state of the LED and the brightness of the touch screen of the second embodiment in a case where the LED continues to be on for a long time.
Figure 8:
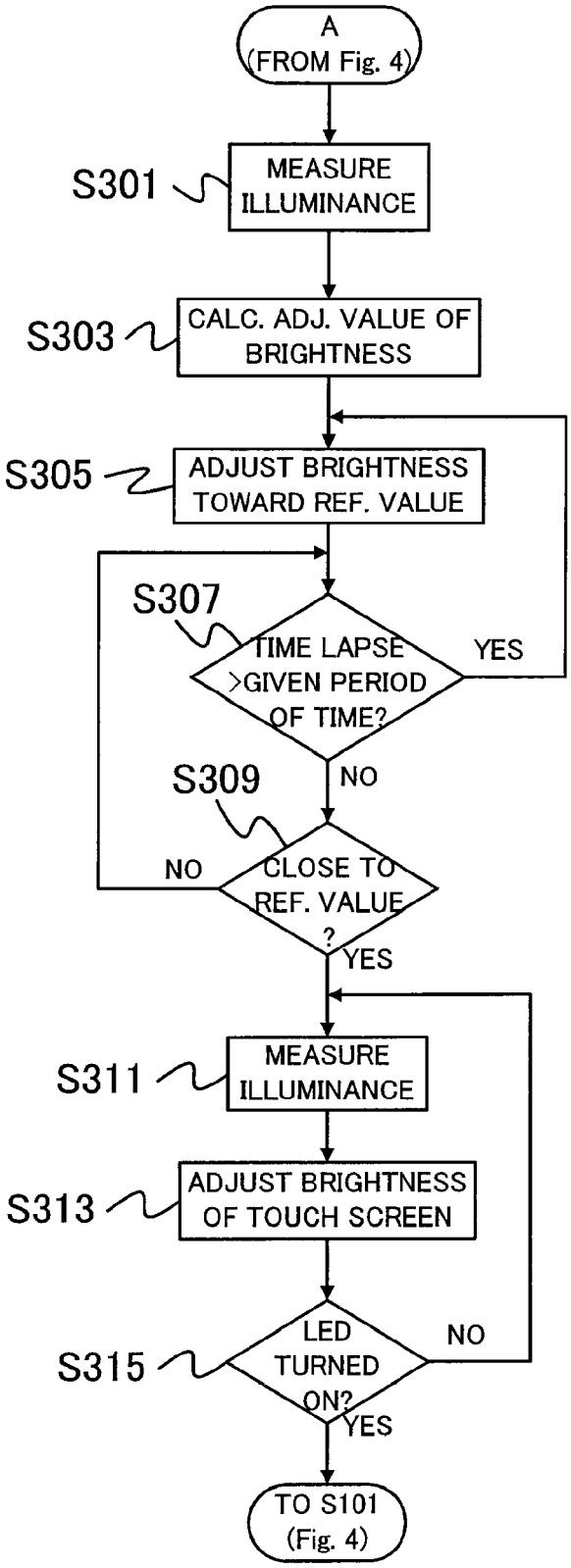
FIG. 8 is a flowchart showing the procedure of the illuminance sensor control process of a second embodiment in a case where the LED continues to be on for a long time.

A second embodiment of the present invention will be described with reference to FIGS. 8 and 9. In the following, each of portions of the second embodiment which is a same as the corresponding one of the first embodiment is given a same reference numeral, and its explanation is omitted. An electronic device of the second embodiment has a same configuration as the mobile phone 1 of the first embodiment shown in FIGS. 1 and 2. The electronic device of the second embodiment has, similarly as the first embodiment as shown in FIG. 3, the main controller 20, the power supply circuit 21, the operation input controller 22, the display controller 23, the memory 24, the voice/sound controller 25, the communication controller 26 and the illuminance detector 27 which are connected to one another through a bus so as to communicate with one another.

The mobile phone 1 of the first embodiment controls the brightness of the touch screen 12 without regard to the ambient illuminance while the LED 14 is being on. Therefore, if the LED 14 continues to be on for a long time, the ambient illuminance may possibly greatly change while the LED 14 is being on. In such a case, currently set brightness of the touch screen 12 may possibly be much different from optimal brightness of the touch screen 12 for actual ambient illuminance, and the brightness of the touch screen 12 may change a lot if the LED 14 is turned off after being on, causing a screen displayed on the touch screen 12 to look flickering as viewed by a user.

In order to address the above problem that may occur in a case where the brightness of the touch screen 12 that was set while the LED 14 was being on is much different from the brightness of the touch screen 12 calculated depending on illuminance measurement after the LED 14 is turned off, the electronic device of the second embodiment is configured to change the brightness of the touch screen 12 step by step so that it comes closer to the brightness of the touch screen 12 calculated depending on the illuminance measurement, and to thereby reduce flickering of a screen on the touch screen 12.

A procedure for the illuminance sensor control process for controlling the on-or-off state of the illuminance sensor 15 performed by the mobile phone 1 of the second embodiment on the basis of the on-or-off state of the LED 14 will be described with reference to a flowchart shown in FIG. 8. The process from S101 to S109 is performed similarly as for the first embodiment, and the process after branching to "YES" at S101 is different from that of the first embodiment.

Upon judging that the LED 14 continues to be on for a long time at S101 ("YES" of S101), the main controller 20 performs a process from S301 to S315 described later, if the LED 14 is turned off after being on. First, the main controller 20 measures ambient illuminance by using the illuminance sensor 15 (S301). Then, the main controller 20 calculates an adjustment value Δ of the brightness of the touch screen 12 on the basis of the illuminance value measured at S301 (S303).

The above adjustment value Δ corresponds to a value by which the brightness of the touch screen 12 changes at once while changing step by step. As indicated by Equation (4), Δ equals a difference between a brightness value y that was set while the LED 14 was being on and a brightness value z of the touch screen 12 calculated on the basis of the illuminance measurement just after the LED 14 was turned off at S301 divided by p (a natural number).

$$\Delta=|z-y|/p \quad (4)$$

The main controller 20 adjusts the brightness of the touch screen 12 on the basis of the adjustment value Δ calculated at S303 so that the brightness of the touch screen 12 comes close to an optimal value for the illuminance measured at S301 (S305).

That is, as shown in following Equations (5) and (6), if a difference between a brightness x(now) of the touch screen 12 that is set just after the LED 14 is turned off and a brightness value x(led) of the touch screen 12 calculated on the basis of the illuminance measured at S301 is equal to or more than Δ, an updated brightness value x(new) of the touch screen 12 is closer to x(led) by Δ than x(now) is.

If the difference between the brightness x(led) of the touch screen 12 calculated on the basis of the illuminance measurement and the currently set brightness x(now) of the touch screen 12 is greater than Δ, $$x(\text{new})=x(\text{led})\pm\Delta \quad (5)$$

If the difference between the brightness x(led) of the touch screen 12 calculated on the basis of the illuminance measurement and the currently set brightness x(now) of the touch screen 12 is equal to or less than Δ, $$x(\text{new})=x(\text{led}) \quad (6)$$

The adjustment of the brightness of the touch screen 12 based on the adjustment value calculated at S303 is performed until the difference between the brightness set on the touch screen 12 and the reference value decreases to Δ or less. If this difference is equal to or less than Δ, x(new) is equal to x(led), and the main controller 20 controls adjustment of the brightness of the touch screen on the basis of the brightness x(led) of the touch screen 12 which is calculated on the basis of the illuminance measurement.

The main controller 20 compares a lapse of time after adjusting the brightness of the touch screen 12 at S305 with a given period of time (e.g., one second) (S307). If the above lapse of time is longer than the given period of time ("YES" of S307), the process returns to S305, and the main controller 20 performs the process from S305 to S307.

If the above lapse of time is not longer than the given period of time ("NO" of S307), the main controller 20 judges whether the brightness of the touch screen 12 adjusted at S305 comes close to the reference value based on the illuminance value obtained at S301 (S309). At this time, if a difference between an actual brightness value of the touch screen 12 and the reference value is equal to or less than the adjustment value Δ calculated at S303, the main controller 20 judges that the brightness of the touch screen 12 comes close to the reference value. Unless the brightness of the touch screen 12 comes close to the reference value ("NO" of S309), the process returns to S307, and the main controller 20 again compares a lapse of time after adjusting the brightness of the touch screen 12 at S305 with a given period of time.

When the brightness of the touch screen 12 comes close to the reference value ("YES" of S309), the main controller 20 measures the ambient illuminance by using the illuminance sensor 15 in order to adjust the brightness of the touch screen 12 on a real-time basis in accordance with the ambient illuminance (S311). Moreover, the main controller 20 adjusts the brightness of the touch screen 12 on the basis of the illuminance measured at S311 (S313).

The main controller 20 judges whether LED 14 was turned on again after the LED 14 was turned off before S301 (S315). At this time, the main controller 20 receives a signal indicating the on-or-off state of the LED 14 from the display controller 23 and judges on the basis of the above signal whether the LED 14 was turned on after being off.

If the LED 14 was not turned on ("NO" of S315), the process returns to S311, and the main controller 20 performs the process from S311 to S315. If the LED 14 was turned on ("YES" of S315), the process returns to S101 and the main controller 20 waits for the LED 14 to be turned off again.

As described above, the mobile phone 1 measures the illuminance only while the LED 14 is being off. Moreover, if the LED 14 blinks before being turned off, the mobile phone 1 adjusts the brightness of the touch screen 12 on the basis of the ambient illuminance. If the LED 14 continues to be on for a long time, the mobile phone 1 adjusts the brightness of the touch screen 12 on the basis of the ambient illuminance just after the LED 14 is turned off. Accordingly, the mobile phone 1 can set optimal brightness on the touch screen 12 in any circumstances.

According to the second embodiment, the mobile phone 1 can adjust the brightness of the touch screen 12 on the basis of the on-or-off state of LED 14 and the ambient illuminance so as to prevent the illuminance sensor 15 from sensing light of the LED 14, even if the LED 14 and the illuminance sensor 15 are arranged close to each other. The mobile phone 1 can thereby properly control the brightness of the touch screen 12 on the basis of the ambient illuminance.

Although the mobile phone 1 has been explained as an example, the electronic device of the present invention is not limited to the mobile phone 1. The present invention can be applied to any kind of electronic device having a display, an LED and an illuminance sensor, such as a PHS (personal handy phone system), a PDA (personal digital assistant) and so on.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electronic device, comprising:

a display unit;

an indicator configured to be turned on for emitting light and to be turned off;

an illuminance sensor configured to sense ambient illuminance; and a controller connected to the display unit, the indicator, and the illuminance sensor, the controller configured to:

cause the illuminance sensor to sense ambient illuminance when the indicator is turned off;

set the brightness of the display unit depending on a value of the ambient illuminance sensed by the illuminance sensor only when the indicator is turned off;

adjust the brightness of the display unit to a reference value when the indicator is continuously turned on over a given length of time; and maintain the brightness of the display unit at a value that is set immediately before the indicator is turned on when a period of time for which the indicator is continuously turned on is shorter than the given length of time.

2. The electronic device according to claim 1, further comprising a memory unit, wherein the controller is further configured to set the brightness of the display unit to a reference value stored in the memory unit upon the indicator continuing to be on for a period of time that is longer than the given time length.

3. The electronic device according to claim 1, further comprising a memory unit, wherein the controller is further configured to adjust the brightness of the display unit step by step to a reference value stored in the memory unit upon the indicator continuing to be on for a period of time that is longer than the given time length.

4. The electronic device according to claim 3, wherein the controller is configured to adjust the brightness of the display unit step by step by updating a current value of the brightness by a fixed increment or decrement each time until a difference between the current value and the reference value becomes smaller than a given threshold.

5. The electronic device according to claim 1, wherein the controller is further configured to set the brightness of the display unit to a value calculated depending on the ambient illuminance upon the indicator being turned off after continuing to be on for a period of time that is longer than a given time length.

6. The electronic device according to claim 1, wherein the controller is further configured to adjust the brightness of the display unit step by step to a value calculated depending on the ambient illuminance upon the indicator being turned off after continuing to be on for a period of time that is longer than a given time length.

7. The electronic device according to claim 6, wherein the controller is configured to adjust the brightness of the display unit step by step by updating a current value of the brightness by a fixed increment or decrement each time until a difference between the current value and the calculated value becomes smaller than a given threshold.

8. A method for controlling display brightness of an electronic device having a display unit, an indicator and an illuminance sensor, comprising:

sensing ambient illuminance of the electronic device by means of the illuminance sensor when the indicator is turned off;

setting the brightness of the display unit depending on a value of the ambient illuminance sensed by the illuminance sensor only when the indicator is turned off;

adjusting the brightness of the display unit to a reference value when the indicator is continuously turned on over a given length of time; and maintaining the brightness of the display unit at a value that is set immediately before the indicator is turned on when a period of time for which the indicator is continuously turned on is shorter than the given length of time.

9. The method for controlling display brightness according to claim 8, further comprising setting the brightness of the display unit to a reference value stored in a memory unit of the electronic device upon the indicator continuing to be on for a period of time that is longer than the given time length.

10. The method for controlling display brightness according to claim 8, further comprising adjusting the brightness of the display unit step by step to a reference value stored in a memory unit of the electronic device upon the indicator continuing to be on for a period of time that is longer than the given time length.

11. The method for controlling display brightness according to claim 10, wherein the brightness of the display unit is adjusted step by step by updating a current value of the brightness by a fixed increment or decrement each time until a difference between the current value and the reference value becomes smaller than a given threshold.

12. The method for controlling display brightness according to claim 8, further comprising setting the brightness of the display unit to a value calculated depending on the ambient illuminance upon the indicator being turned off after continuing to be on for a period of time that is longer than a given time length.

13. The method for controlling display brightness according to claim 8, further comprising adjusting the brightness of the display unit step by step to a value calculated depending on the ambient illuminance upon the indicator being turned off after continuing to be on for a period of time that is longer than a given time length.

14. The method for controlling display brightness according to claim 13, wherein the brightness of the display unit is adjusted by updating a current value of the brightness by a fixed increment or decrement each time until a difference between the current value and the calculated value becomes smaller than a given threshold.

* * * * *